United States Patent [19]

Bertels

[11] 4,309,124

[45] Jan. 5, 1982

[54] REINFORCED ASPHALT LAYER

[75] Inventor: Augustinus W. M. Bertels, Arnhem, Netherlands

[73] Assignee: Bruil-Arnhem Wegenbouw B.V., Arnhem, Netherlands

[21] Appl. No.: 117,548

[22] Filed: Feb. 1, 1980

[30] Foreign Application Priority Data

Feb. 15, 1979 [NL] Netherlands ..... 7901193

[51] Int. Cl.[3] ..... E01C 5/08; E01C 11/16; E04C 5/01

[52] U.S. Cl. ..... 404/70; 52/414; 52/660; 404/100; 404/134

[58] Field of Search ..... 404/70, 100, 134; 52/414, 660, 664, 665, 670

[56] References Cited

U.S. PATENT DOCUMENTS

| | | | |
|---|---|---|---|
| 693,966 | 2/1902 | Henkel | 52/414 X |
| 1,110,295 | 9/1914 | Phillips | 404/70 |
| 1,613,063 | 1/1927 | Stark | 404/70 |
| 1,641,523 | 9/1927 | Bell | 52/664 X |
| 1,707,939 | 4/1929 | MacKenzie | 404/70 |
| 2,078,485 | 4/1937 | Dunham | 404/70 X |
| 2,115,667 | 4/1938 | Ellis | 404/70 |
| 2,139,816 | 12/1938 | Fordyce | 404/70 |

FOREIGN PATENT DOCUMENTS

| | | | |
|---|---|---|---|
| 1459734 | 2/1969 | Fed. Rep. of Germany | 404/70 |
| 331848 | 10/1903 | France . | |
| 576548 | 8/1924 | France | 404/70 |
| 921473 | 5/1947 | France . | |
| 386142 | 1/1933 | United Kingdom | 404/70 |
| 885115 | 12/1961 | United Kingdom | 404/70 |

*Primary Examiner*—Rodney H. Bonck
*Attorney, Agent, or Firm*—Diller, Ramik & Wight

[57] ABSTRACT

A reinforced asphalt layer, consisting of an asphalt-forming mixture of bitumen with mineral particles, in which is embedded a reinforcing network of elongated reinforcing elements which, where they intersect one another, have a connection to one another which at least to a certain degree fixes the cross-bond, in which the reinforcing elements at least locally have a cross-section of maximum linear dimension of the order of the particle size, and a shape such as to exhibit a change of direction longitudinally from location to location of their engagement of the surrounding material of the layer, the arrangement being such that in a finished, rolled asphalt layer the reinforcing elements have adjusted locally to the mineral particles by deformation, on the one hand, and the reinforcing network has largely retained its elasticity, on the other.

4 Claims, 7 Drawing Figures

FIG.1
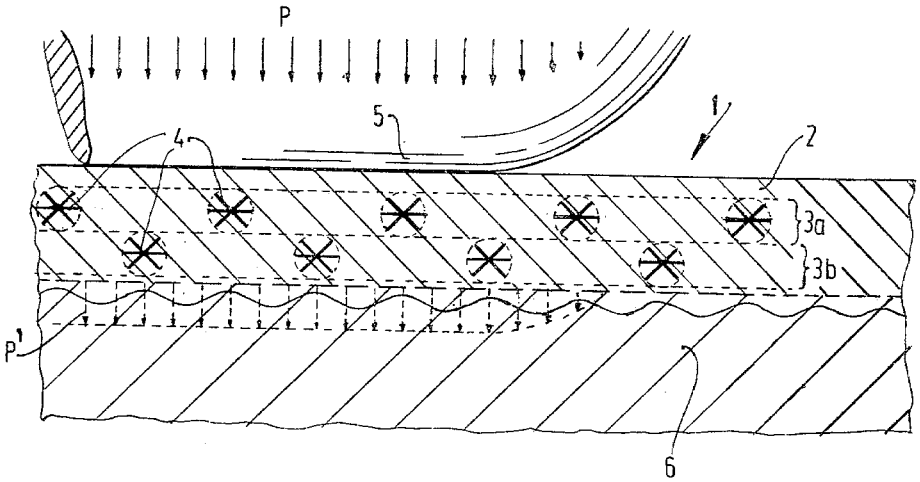
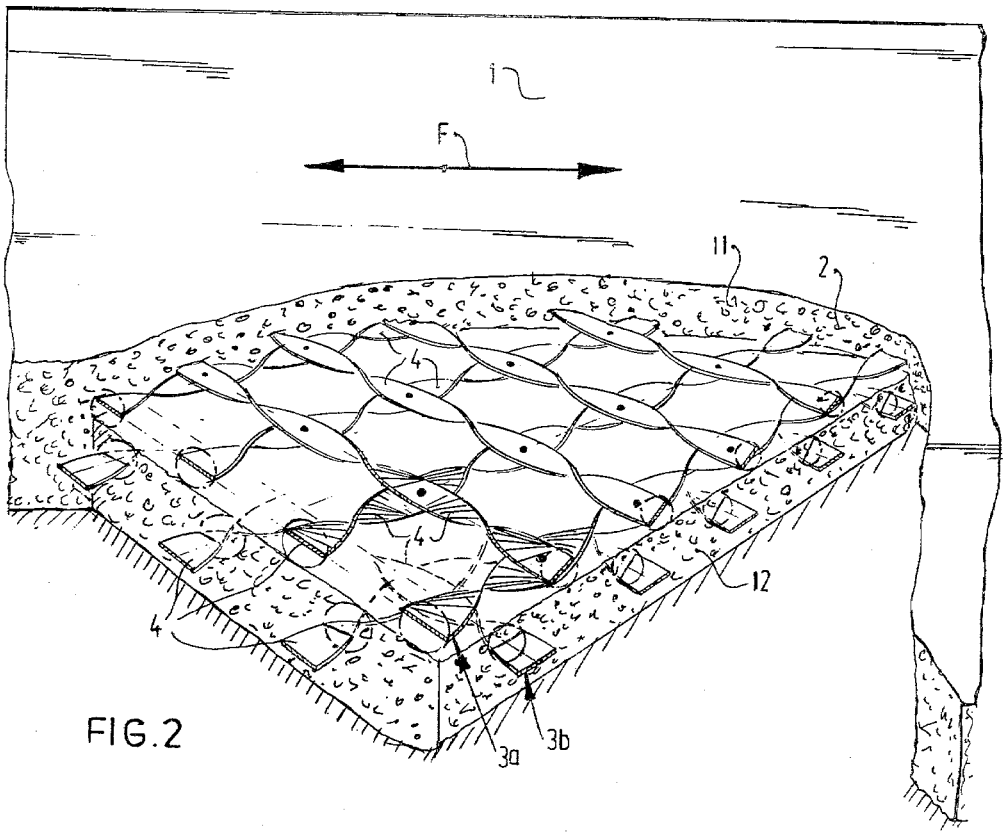
FIG.2

REINFORCED ASPHALT LAYER

This invention relates to a reinforced asphalt layer, consisting of an asphalt-forming mixture of bitumen with mineral particles, in which is embedded a reinforcing network of elongated reinforcing elements which, where they intersect one another, have a connection to one another which at least to a certain degree fixes the cross-bond.

When an asphalt layer of this kind is employed, for example as disclosed in French Specification No. 921,473, deformation of the road surfacing frequently occurs after some time. For example, track-formation, rib-formation and possibly crack-formation may occur in an asphalt layer as a result of high traffic loading.

The object of this invention is to bring about an improvement in this respect and provide a reinforced asphalt layer which offers sufficient resistance to the above deformations.

To this end, in a reinforced asphalt layer of the type referred to hereinabove, according to the invention, the reinforcing elements at least locally have a cross-section of maximum linear dimension of the order of the particle size, and a shape such as to exhibit a change of direction longitudinally from location to location of their engagement of the surrounding material of the layer, the arrangement being such that in a finished, rolled asphalt layer the reinforcing elements have adjusted locally to the mineral particles by deformation, on the one hand, and the reinforcing network has largely retained its elasticity, on the other.

In this context, the term "particle size" used is taken to mean the same basically statistical term applying to the determination of particle sizes (by sieve grading) which characterizes the chosen mixture distribution.

As will be apparent from the above description of a reinforced asphalt layer according to the invention, the elongated reinforcing elements are so joined to one another at their intersections as to fix the cross-bond of the reinforcing network to some extent. This means that a reinforcing element of this kind can transmit any longitudinal forces to the transverse elements and distribute these thereover and, in turn, the reinforcing element is reinforced in its resistance to transverse displacements within the asphalt layer by these intersecting elements. This property, as well as that of a good engagement with the asphalt layer material, such engagement changing direction from location to location, gives the reinforcing network an action which resembles that of a membrane, on the one hand, and produces a most favourable hydrostatic condition of the asphalt, on the other. The requirement that the longitudinal elements should at least locally have a cross-section of maximum linear dimension of the order of the characteristic particle size serves to ensure that the network membrane formed by the reinforcing elements actually does engage the surrounding mixture and that the desired transmission of forces between the mineral particles of the asphalt material, on the one hand, and the reinforcing elements, on the other, actually results, the reinforcing elements adjusting to the mineral particles due to local deformation when the asphalt layer is being rolled. If this were not so, the reinforcing elements could move relatively easily with respect to the particles, so that the membrane and hydrostatic effects generated by the reinforcing network would be lost.

The measure proposed by the invention to the effect that the reinforcing elements engage the surrounding material in such a manner as to change direction longitudinally from location to location not only serves to ensure good engagement of the reinforcing network on the apshalt but also to ensure that the shear forces exerted by the network membrane on the envisaged reinforced layer are at a maximum so that, for example, lateral creep of an asphalt layer is counteracted. Additionally, it ensures that a reinforcing element subjected to loading transmits the forces in its consecutive longitudinal sections to the mineral particles of the layer in ever changing directions, so that the force-distributing effect is intensified.

For application with the invention, the reinforcing elements described for uni-dimensional use in French Specification No. 331,848 may be considered, such elements having, for example, the form of an at least locally twisted band or strip of metal, e.g. stainless steel or steel which has been corrosion-treated. The width of such a strip may be selected according to the particle size of the gravel used, whereas the fact that the orientation of the cross-section is continually changing, not only ensures good engagement with the surrounding material but, in addition, an ever-changing direction of transmission of forces to the mineral particles. The adherence to the intersecting reinforcing elements results in the said membrane effect inter alia. A reinforcing element of this kind, which can be regarded as a special product of the invention, has sufficient flexibility locally for taking loading forces and transmits forces in such a manner, for example to the mineral particles of the asphalt, that the latter, due also to the action of other such reinforcing elements, is unable to shift with respect to the reinforcing elements, and therefore will not show creep.

According to the invention, a good connection between the elements is facilitated if the outer surfaces of two intersecting reinforcing elements, facing one another where they intersect, substantially coincide. When the afore-mentioned twisted metal strips are used as reinforcing elements, it is preferable, according to the invention, that one of two intersecting reinforcing elements is twisted clockwise and the other one counterclockwise, respectively.

In many cases, according to the invention, at least two reinforcing networks are embedded in the layer substantially directly above one another with a relative offset of substantially half the mesh dimension in the main directions. This produces the effect that the normal loading forces of the layer, where they engage in between two reinforcing elements of the network, find a longitudinal element of the other network so that not only distribution of the normally directed loading forces over a multiple of reinforcing networks, each with its own membrane effect, is obtained but that in addition, and to a greater degree than by the presence at some distance of two reinforcing elements of one and the same network, the mineral particles are prevented from being displaced within the layer. Such particles situated between two reinforcing elements of one and the same network in many instances transmit a force to a reinforcing element of the other network which, in turn, then will act as a membrane. These particles which are, as it were, "captivated" by the two reinforcing networks above one another experience equal loading in all directions. This resembles a hydrostatic condition in which the resultant force on each particle is substantially zero, so that the particles experience minimum displacement forces and that no material creep occurs.

The invention will be elucidated in the following description with reference to the accompanying drawing wherein:

FIG. 1 is a diagrammatic vertical cross-section in the direction of travel through a portion of road surfacing constructed in the form of a reinforced asphalt layer according to the invention and subjected to loading by a motor vehicle tire.

FIG. 2 is a diagrammatic perspective of a partially exploded view of the road shown in FIG. 1.

Figure 3:
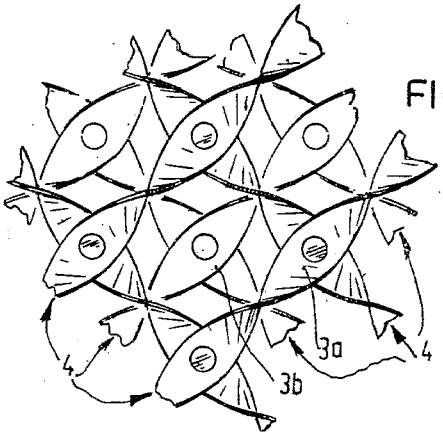
FIG. 3 is a top plan view of a pair of reinforcing networks which are arranged in a staggered relationship to one another for embedding in an asphalt layer according to the invention.

The road surfacing portion shown diagrammatically in FIG. 1 is constituted by a reinforced asphalt layer 1 consisting of an asphalt-forming mixture 2 of bitumen and mineral particles (not shown separately in the drawing). In the embodiment of a reinforced asphalt layer shown in FIG. 1, two networks 3*a* and 3*b* are embedded in the mixture, the elongated reinforcing elements 4 thereof being shown only diagrammatically in FIG. 1 and to be described in detail hereinafter. A motor vehicle tire 5 shown partially rests on the asphalt layer 1, and its load pressure distribution, i.e. the distribution in the direction of travel (assumed to be horizontal in FIG. 1) of the pressures exerted by the tire 5 on the asphalt layer 1, is shown diagrammatically by means of solid-line arrows P. It will be seen clearly that the tire 5 is subjected to deformation during the loading, i.e. is flattened at the underside.

Just as the arrows P illustrate the load pressure distribution in the top part of FIG. 1, so the broken-line arrows P′ in the bottom part of FIG. 1 digrammatically illustrate the pressure distribution which would occur as a result of the base 6 being loaded by the asphalt layer if no reinforcing networks 3 were used. As already stated, in such cases, given high traffic loading, deformation of the non-reinforced asphalt layer can occur after some time; track-formation, rib-formation and crack-formation, for example, are generally known in asphalt layers. Experiments carried out hereinbefore with the embedding of reinforcing networks containing elongated reinforcing elements, e.g. plastics filaments or strands, to provide an improvement in this respect have not appeared successful.

Figure 4:
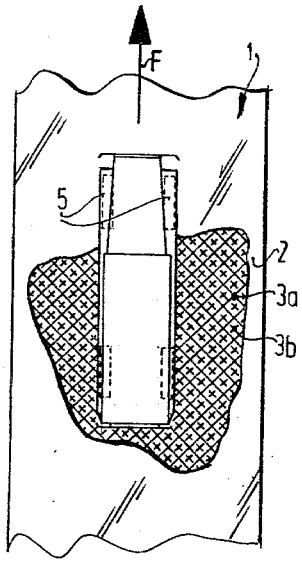
FIG. 4 is a diagrammatic top plan view at a considerably smaller scale showing a portion of road surfacing subjected to loading by a motor vehicle and illustrating a part of a reinforcement according to the invention.

FIGS. 2, 3 and 4 illustrate the way in which, using reinforcing networks 3 with elongated reinforcing elements 4 according to the invention, a good result is obtained.

According to the invention, the reinforcing elements are to have, at least locally, a cross-section whose maximum linear dimension is of the order of the particle size, and a construction, e.g. shape, such as to exhibit good holding in the asphalt and, where they cross one another, a cross-bond fixation at least to some extent. These aspects will now be discussed in sequence.

In the first place it is pointed out that the term "particle size" is to be understood as the basically statistical term of the same name which, in the determination in practice of particle sizes, by sieve-grading in practice, characterizes the mixture. Since this statistical term is a familiar term to those versed in the art, it will not be discussed here in greater detail. Suffice it to say that, for the embodiment here described for example, 15 to 20 mm may result in practice as the maximum linear dimension of the cross-section of a reinforcing element 4 from this term. For instance, a flap strip of stainless steel or corrosion-treated steel with cross-sectional dimensions of, for example, 20 mm and 1 mm respectively, is envisaged.

Figure 5:
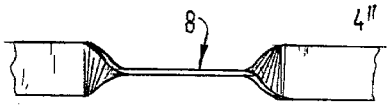
FIGS. 5 and 6 are top plan views of two different embodiments of reinforcing elements for application in a reinforced asphalt layer according to the invention and FIG. 7 is a view similar to FIGS. 5 and 6 showing a pair of intersecting reinforcing elements according to yet another embodiment of the invention.
Figure 6:
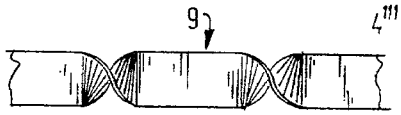
Figure 7:
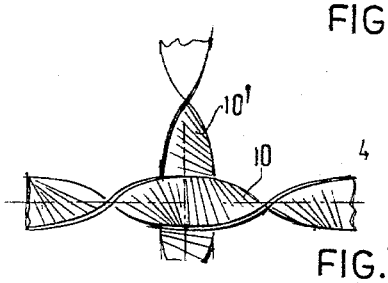

Various procedures may be followed for satisfying the requirement that the reinforcing elements exhibit good holding in the asphalt. FIGS. 5, 6 and 7 show a number of embodiments of a reinforcing element through which the required results can be obtained. Generally speaking, in order to obtain fixations which are retained under all circumstances when a reinforcing element is subjected to loading from different directions, reinforcing elements must be used such that the direction of the maximum linear dimension of their cross-section has a change, preferably a change of at least 90°, in the longitudinal direction of the element. Such a requirement concerning the construction of a reinforcing element generally can be satisfied by the choice of a special cross-sectional shape and the configuration of that shape in the longitudinal direction of the element.

FIG. 5 shows an embodiment 4″ of a reinforcing element according to the invention. This reinforcing element 4″ consists of a strip 8 of corrosion-resistant steel having a cross-section of $20\times1$ mm$^2$ for example, the strip being twisted through an angle of 90° at regularly distributed intervals along its longitudinal axis. FIG. 6 shows a reinforcing element 4‴ consisting of a similar strip 9 twisted through an angle of 180° at regularly distributed intervals along its longitudinal axis. It is also possible to use twist angles other than 90° and 180°, regularity being of some importance, as will be explained hereinafter.

FIG. 7 shows a pair of intersecting reinforcing elements 4 both consisting of a strip 10, 10′, respectively, both twisted continuously in their longitudinal direction. As a result of the fact that the strip 10, which is the horizontal one in FIG. 7, is twisted clockwise, while the strip 10′, the vertical one in FIG. 7 is twisted counterclockwise, the outer surfaces facing one another at the intersection substantially coincide, thus facilitating good connection between the two reinforcing elements 4 at the location of their crossing. It will also be clear that the engagement surface continually changes in the longitudinal direction of the element with the two reinforcing elements shown in FIG. 4, so that a reinforcing network 3 (see FIGS. 1, 2 and 3) consisting of reinforcing elements 4 according to FIG. 7 lends itself optimally for taking-up and transmitting loads in all directions. However, reinforcing elements constructed quite differently from those in FIGS. 5 to 7 may clearly be considered for use in some cases also. Important is only a cross-sectional shape such that a reinforcing element subjected to loading should always transmit, in its consecutive longitudinal sections, the forces occurring to the mineral particles of the asphalt in ever varying directions. The force-distributing effect of the reinforcing elements thus is intensified.

The following remarks apply to the requirement that the reinforcing elements exhibit a connection to one another such as to establish fixation at least to a certain degree where these elements intersect. With the ing tion it is feasible that the joining of two crossreinforcing elements is realized by a mechanical action, e.g. punching, addition of an external fixation device, e.g. a clamp, a button or a nail, or by welding or gluing. The various feasible fixation methods, the applicability of which will vary from case to case usually with the cross-sectional shape of the reinforcing elements, are generally known per se. The merits and the implementation of the various fixation methods will not therefore be discussed in detail here. In the embodiments of reinforcing networks 3 shown in FIGS. 2 and 3, having reinforcing elements 4 according to FIG. 7, two intersecting reinforcing elements 4 always have been fixed to one another by spot welding. In this connection it is important that the outer surfaces of two crossing reinforcing elements 4 facing one another should coincide at the place where they cross, as already described particularly with reference to FIG. 7. As already stated there, this effect is obtained with the reinforcing element 4 according to FIG. 7 (see also FIGS. 2 and 3) by employing of a clockwise-twisted strip 10 and a counter-clockwise twisted strip 10'. As already mentioned in the case of the reinforcing elements 4'' and 4''' according to FIGS. 5 and 6, respectively, the regularity of the change of cross-section is important in this connection. However, it will be clear that lack of such regularity of change of cross-section is unimportant with respect to certain fixation methods.

The afore-going is a description of various details of reinforcing elements according to the invention resulting in a holdfast in the asphalt capable of being subjected to loading in different directions, and in mutual adherence at the intersection of two elements of one and the same network. The distribution of the reinforcing elements over a reinforcing network and the effect thereof will be discussed below with reference to FIGS. 1 to 4 of the drawing.

In FIG. 1, the various reinforcing elements 4 of the two networks 3a and 3b are always shown with a broken circular contour, in which three different sections through a strip 10 or 10' (see FIG. 7) are shown in solid-lines without distinction. Such a symbolic and basically not completely correct illustration has been chosen in order to prevent FIG. 1 from being difficult to interpret because of too much detail. In reality, a contour line of this kind forming the collection of all the most outward points of a reinforcing element 4, will be recognizable only in a plane extending perpendicularly to the longitudinal axis of a reinforcing element 4. In FIG. 1, the longitudinal axes of the reinforcing elements 4, however, do not extend perpendicularly to the drawing plane. The actual situation will be clear particularly from FIGS. 2 and 4. In these two figures, the direction of travel associated with the road surfacing in question is shown by an arrow F.

As will be apparent from FIGS. 2 and 4, the reinforcing elements 4 extend with their longitudinal direction at equal angles, of for example +45° and −45°, respectively with respect to the direction of travel F. It will be clear that such an orientation of the reinforcing elements for a reinforcing network gives two main directions of reinforcement, i.e. one in the direction of travel F and one perpendicularly to the travel of direction F.

It is pointed out that the top part of FIG. 2 (i.e. at the double arrow F) shows a finished portion of road surfacing 1 extending in the horizontal plane, and beneath it an approximately vertically extending excavation wall 11 with the mixture 2 of bitumen with mineral particles, and beneath this a triangular portion of a top reinforcing network 3a, again extending in the horizontal plane, followed therebeneath by an excavation wall 12 adjoining along two sides of the triangle and consisting of the said mixture 2, parts of reinforcing elements 4 (also shown partially in broken-lines in FIG. 2) of a bottom reinforcing network 3b projecting on either side of said mixture. The road surfacing extending beneath the wall 11 in FIG. 2 is regarded as omitted.

A top reinforcing network 3a and a bottom network 3b can be seen in each case in FIGS. 1, 2 and 3. As will be clear from these figures, the two reinforcing networks 3a and 3b are embedded in the asphalt layer 1 so as to be offset from one another in the horizontal direction in such a manner that the two reinforcing networks are always embedded in the asphalt layer one above the other so as to be offset from one another by half the mesh pitch in their main directions. The reinforcing effect of such an asphalt layer according to the invention is shown in FIG. 1 by a solid oscillating line extending through the arrows P'. This oscillating line has a smaller (vertical) amplitude than the arrows P' and extends over a greater distance in the direction of travel (and in the transverse direction) than the arrows P'. The effect has the character of distribution over a greater part of the base 6.

An explanation has already been given hereinbefore concerning the action of a reinforced asphalt layer according to the invention, and more particularly the action of the reinforcing networks and reinforcing elements thereof. It is assumed that the reinforcing elements 4 transmit any longitudinal forces to crossing elements 4 and distribute them over the latter while they in their turn are strengthened by these crossing elements 4 in their resistance to displacement in the transverse direction within the asphalt bed. This property, together with that of good holding in the asphalt, gives the reinforcing network an action which on the one hand is similar to that of a membrane and on the other hand produces a hydrostatic condition in the asphalt. The other requirement discussed above, i.e. that the reinforcing elements 4 should at least locally have a cross-section whose maximum linear dimension is of the order of the characteristic particle size serves to ensure that the network membrane formed by the reinforcing elements really does act on the asphalt and provides the required transmission of forces between the mineral particles of the asphalt mixture, on the one hand, and the reinforcing elements themselves, on the other. The change of direction of the maximum linear dimension of the cross-section of a reinforcing element is particularly important in connection with this latter aspect. This prevents the reinforcing elements from cutting through the asphalt layer in the event of the latter being loaded in the direction of the membrane plane, i.e. the network plane. This prevents the asphalt layer being cut into horizontal slices. In addition, this measure enhances the transmission of forces in ever varying directions, and this probably forms an important effect.

It should be noted that the explanation of the action of reinforced asphalt layer according to the invention offered above is based on hypotheses and must not be interpreted as a limitation of the invention.

What I claim is:

1. A reinforced asphalt layer, consisting of an asphalt-forming mixture of bitumen with mineral particles having a characteristic particle size, in which is embedded a reinforcing network of elongated reinforcing elements which, where they intersect one another, have a connection to one another which at least to a certain degree fixes the cross-bond, said reinforcing elements at least locally having a cross-section providing a width dimension of the order of said characteristic particle size and a thickness much less than said width dimension, and said elements being non-planar so as to change orientation of said width dimension longitudinally from location to location of their engagement of the surrounding material of the layer, whereby in a finished, rolled asphalt layer the reinforcing elements adjust locally to the mineral particles by deformation, on the one hand, while the reinforcing network largely retains its elasticity, on the other.

2. A reinforced asphalt layer according to claim 1, characterized in that the outer surfaces of two intersecting reinforcing elements, facing one another where they intersect, substantially coincide.

3. A reinforced asphalt layer according to claim 2, characterized in that one of two intersecting reinforcing elements is twisted clockwise and the other one counter-clockwise, respectively.

4. A reinforced asphalt layer according to any one of the preceding claims, characterized in that two reinforcing networks are embedded in the layer substantially directly above one another with a relative offset of substantially half the mesh dimension in the main directions.

* * * * *